United States Patent [19]

Folsom

[11] Patent Number: 4,930,418

[45] Date of Patent: Jun. 5, 1990

[54] METHOD FOR SEALING OPTICAL WINDOWS IN EXPLOSIVE INITIATORS

[75] Inventor: Mark Folsom, Hollister, Calif.

[73] Assignee: Whittaker Ordnance, Inc., Hollister, Calif.

[21] Appl. No.: 370,495

[22] Filed: Jun. 23, 1989

[51] Int. Cl.[5] ..... F42C 19/00; C03C 27/02; C03C 29/00

[52] U.S. Cl. ..... 102/201; 65/43; 65/154

[58] Field of Search ..... 102/201; 65/36, 42, 65/43, 59.1, 59.3, 59.34, 59.4, 152, 154

[56] References Cited

U.S. PATENT DOCUMENTS

| | | | |
|---|---|---|---|
| 3,069,876 | 12/1962 | Certa et al. | 65/154 |
| 3,296,795 | 1/1967 | Nielsen et al. | 102/201 |
| 3,362,329 | 1/1968 | Epstein | 102/201 |
| 3,367,696 | 2/1968 | Langley | 65/154 |
| 3,528,372 | 9/1970 | Lewis et al. | 102/201 |
| 3,672,858 | 6/1972 | Berg | 65/43 |
| 4,343,242 | 8/1982 | Welk | 102/201 |

*Primary Examiner*—Charles T. Jordan
*Attorney, Agent, or Firm*—Donald E. Nist

[57] ABSTRACT

The method seals optical windows in explosive initiators so that the resulting seal remains undamaged by exposure to about - 320°-840° F. and pressures up to 26000 psi. The method includes disposing a solid body optical window of quartz or silica glass or the like in a passageway in a wall of an explosive initiator body of metal, ceramic or the like. The optical window is dimensioned relative to the passageway so that an annular space is provided between the outer periphery of the optical window and the passageway wall. This annular space is filled with solder glass, in powdered or solid body or slurry form. Preferably, the solder glass is a ring which closely fits around the optical window. The resulting sub-assembly preferably abuts a shelf in the passageway formed between two contiguous portions of the passageway with different diameters, the sub-assembly being in the larger portion. The assembly of solder glass, optical window and initiator body is then heated to above the melting point of the solder glass, e.g. about 450° C. and held at this temperature until the solder glass melts and fuses to the optical body and passageway wall, sealing the optical body in place. The assembly is then cooled to ambient temperature.

10 Claims, 1 Drawing Sheet

METHOD FOR SEALING OPTICAL WINDOWS IN EXPLOSIVE INITIATORS

BACKGROUND OF THE INVENTION

1. Field of the Invention

The present invention generally relates to a sealing method, and more particularly to an improved method for sealing optical windows in explosive initiators.

2. Prior Art

Certain explosive initiators employ optical windows to transfer light from a laser source into the device to initiate an explosion. Some initiators of this type have been made using finished windows that are sealed to the initiator walls with polymeric materials such as epoxy resin. Other optical windows have been made by casting glass into a hole in a metal plate and then grinding, polishing and coating it while in the metal plate, and finally welding the metal plate to the rest of the cartridge body to form the finished sealed optical window.

However, polymeric seals generally have higher leak rates than are acceptable for many explosive initiator applications and cannot stand extreme temperatures and pressures. Moreover, casting an optical window into a metal part and finishing the subassembly before welding it into a cartridge has the disadvantage of being a process with many steps, each of which adds to labor costs and the potential for loss from mistakes. It also limits design flexibility and reduces the number of parts that can be processed at once in a given piece of equipment in contrast to the larger number that can be done if the windows alone are processed.

Accordingly, there remains a need for an improved method of sealing optical windows into explosive initiators. Such method should be rapid, simple, inexpensive, reproducible and efficient. It should provide high quality optical window seals capable of withstanding extremes of temperature and pressure without leaking.

SUMMARY OF THE INVENTION

The improved method of the present invention satisfies all the foregoing needs. The method is substantially as set forth in the Abstract of the Disclosure.

The method of the present invention has been shown to yield seals with extremely low leak rates. The seals have been shown to remain undamaged by exposure to temperatures as low as −320° F and as high as 840° F and pressures up to 26000 psi. The present method allows sealing of windows in their finished form, including coatings, into a finished cartridge initiator body with no discernible degradation to the optical window, the seal or the initiator. Also, the sealing method is performed in a single step, which tends to minimize losses during practice of the method.

The method is preferably practiced by employing a solid ring or doughnut of low temperature melting glass, that is, conventional solder glass. The ring is first fitted around the window, so that it abuts the periphery of the solid body of optical glass, such as quartz or silica glass, comprising the window. The ring is dimensioned to fill an annular space between the optical window and the wall defining the passageway in the metallic or ceramic initiator body into which the ring and window sub-assembly is inserted.

Preferably the initiator passageway has contiguous larger diameter and smaller diameter portions defining a shelf therebetween. The ring slidably fills the larger portion, and the ring and window sub-assembly abut the shelf so that they are easily maintained in place when the whole assembly (ring, window and initiator body) is then heated to above the melting point, e.g. 450° C, of the solder glass and held at that temperature, e.g. 1–1.5 hrs., until the solder glass melts and fuses to the initiator wall and shelf and the optical window to seal the window in place. The assembly is then cooled to ambient temperature in, for example, 0.5–1.0 hrs. to complete the method.

The solder glass can comprise powdered glass or an aqueous or other slurry of solder glass particles, if desired. In any event, enough solder glass is placed in the annular space between the window and passageway wall to fill it before the heating and fusing step.

Various other features of the improved method of the present invention are set forth in the following detailed description and accompanying drawings.

DRAWINGS

FIG. 1 is a schematic side elevation, partly in section, of a typical laser light initiated explosive initiator employing an optical window sealed in accordance with the present method; and FIG. 2 is an enlarged fragmentary schematic cross-section of the optical window, solder glass body and initiator passageway portions of the initiator of FIG. 1.

DETAILED DESCRIPTION

FIGS. 1 & 2

Figure 2:
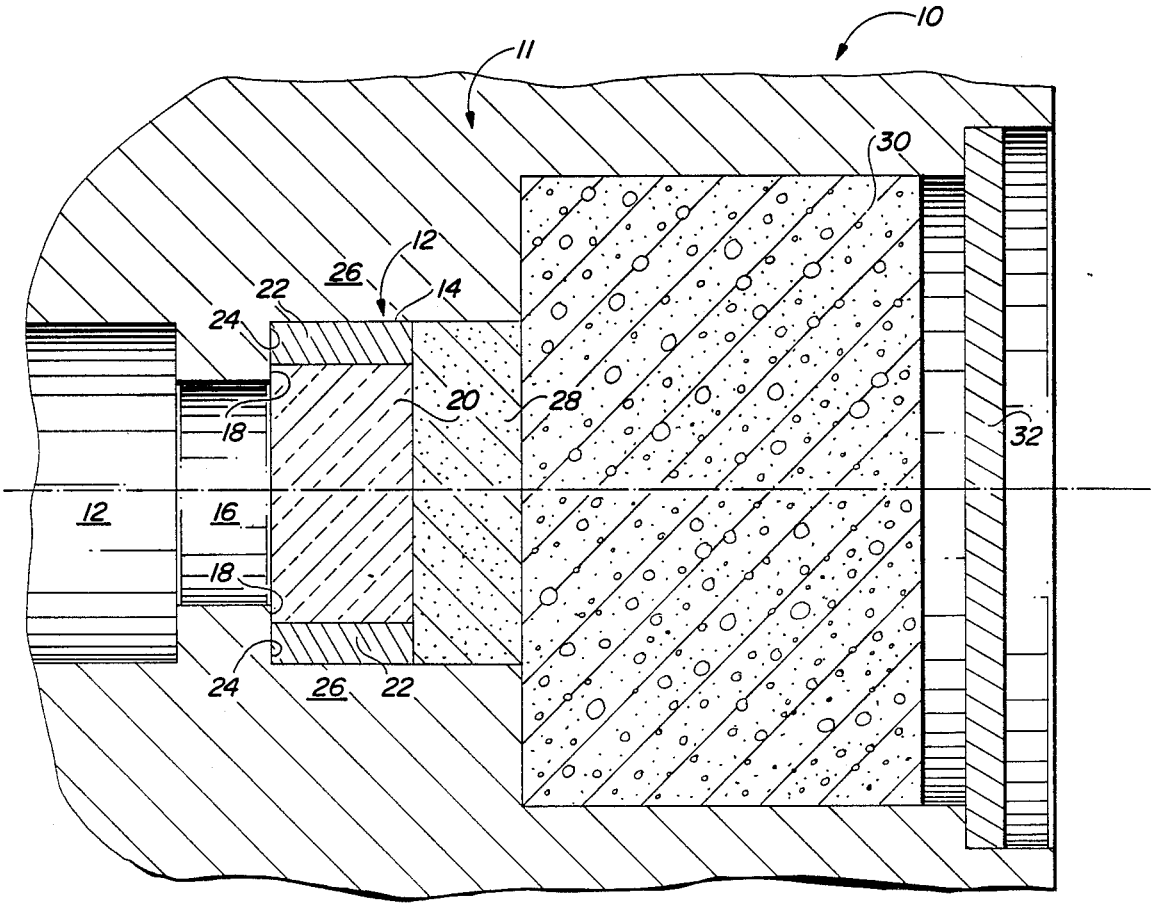

Now referring more particularly to the drawings, a laser light-activatable explosive initiator is schematically depicted therein. Thus, initiator 10 is shown, which comprises a solid body 11 of metal, such as austenitic stainless steel or the like, or a ceramic or other high temperature resistant stable body. Initiator body 11 has a generally central, preferably cylindrical, passageway 12 extending longitudinally therethrough, which includes a relatively larger diameter central portion 14 contiguous with a relatively smaller diameter central portion 16, defining therewith an annular shelf 18 (FIG. 2).

In accordance with the present method, a solid body optical window 20 of high temperature resistant transparent material such as quartz or silica glass is placed in passageway 12 so that it abuts shelf 18. Window 20 preferably is a cylinder. Portion 16 is of smaller diameter than window 20. Window 20 is centered in passageway 12.

Preferably, a ring 22 of solder glass of about the same length as window 20 and dimensioned to abut the outer periphery of window 20 is placed around window 20 before the resulting subassembly is slid into the passageway 12 and into abutting relation with shelf 18. The outer diameter of ring 22 is such as to closely slide in passageway 12, thus filling the annular space 24 between window 20 and the sidewall 26 defining portion 14 of initiator body 11. Thus, ring 22 acts to automatically center window 20 in passageway 12.

Figure 1:
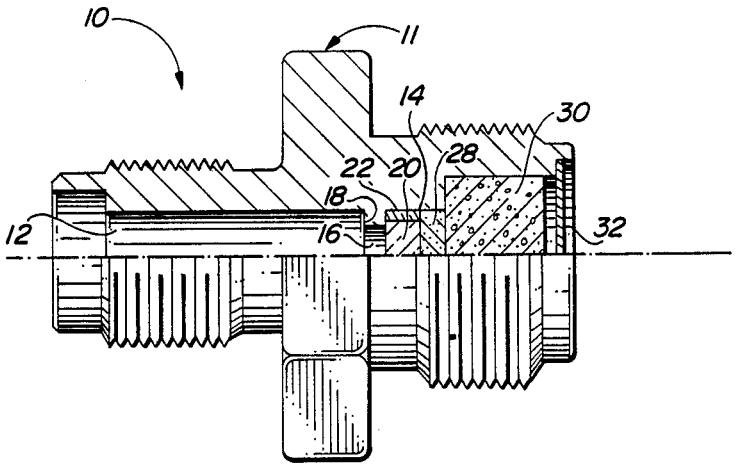

The entire assembly is then placed in an oven or other heating device and heated to above the melting point of the solder glass ring 22, that is, usually above about 430° C. or so, preferably to about 450° C. over a suitable period of time; e.g. 0.5 hr. and then held at that temperature until the solder glass melts and fuses to the shelf 18, sidewall 26 and window 20, totally sealing window 20 in passageway 12 to prevent any leakage. This usually occurs within about 0.5–1.0 hr., after which the assembly is cooled to ambient temperature, e.g., in about 0.5–1 hr., that is, at a rate sufficiently slow to prevent cracking of the window and seal. The finished initiator body 11 is then ready for use, after filling it with a conventional consolidated prime 28 and a conventional explosive load 30 and welding or otherwise securing an output closure 32 in place (FIG. 1).

It will be noted that the present method can be carried out using a powdered or granular solder glass or a slurry thereof in place of the ring 22. In that event, body 12 is tilted into the vertical position and body 20 is then centered against shelf 18 in portion 14, after which the powdered or slurry mass of solder glass is passed into passageway 12 to fill space 24. The assembly is then treated and cooled as previously described, the fused solder glass thereupon keeping window 20 permanently centered against shelf 18.

The present method is simple, economical, efficient and reproducible. It also is adapted for use in automated production procedures. Further features are set forth in the following specific Examples.

EXAMPLE I

A generally cylindrical austenitic steel initiator body having a length of 20 mm., an average diameter of about 10 mm. and the configuration shown in FIGS. 1 & 2 is fitted with a sealed optical window as follows:

The cylinder of high temperature, optical glass, resistant to 840° F. temperature and having a diameter of 3 mm. and length of 3 mm. is slide fitted inside a cylindrical ring of solid solder glass having a melting point below about 450° C., and an I.D. of about 3.05 mm. and an O.D. of 3.95 mm. This sub-assembly is then slid through a cylindrical longitudinal passageway having a diameter of 4 mm. to an annular shelf defined by the conjunction of the first passageway with a contiguous cylindrical passageway having a diameter of 2 mm. The sub-assembly is made to abut the shelf.

The resulting assembly of initiator body, window and ring is placed in an oven and heated in 30 mins. to 450° C., and held at that temperature for 1 hr., during which time the solder glass melts and fuses to the initiator passageway and shelf and to the window, sealing the window in place against leakage, after which the assembly is cooled in 30 mins. to ambient temperature.

This assembly is then removed from the oven and the initiator body is filled with a conventional consolidated prime and an explosive load in the passageway immediately downstream of the window, and then the output end of the passageway is closed with a plate welded in place, so as to provide the finished initiator. The window withstands temperatures as low as −320° F. and as high as 840° F. and pressures of up to 26000 psi without leaking.

EXAMPLE II

The method of Example I is followed, except for the following changes:

(a) The solder glass is in the form of a powder and is placed in the annular space between the outer periphery of the window and the adjacent passageway wall, after first tilting the initiator body 90 up to a vertical orientation so that the output end thereof is up and vertical, and then sliding the window into the passageway and centering it on the shelf; and, (b) the heating and cooling steps are carried out with the initiator body in the described vertically tilted position. The results are substantially the same as in Example I.

EXAMPLE III

The method of Example II is followed, except that a thick slurry of solder glass in water is used in place of the powder, and the heating is longer by about 20 minutes to allow for the aqueous evaporation. The results are similar to those of Example II.

Various modifications, changes, alterations and additions can be made in the improved method of the present invention, its steps and parameters. All such modifications, changes, alterations and additions as are within the scope of the appended claims form part of the present invention.

What is claimed is:

1. An improved method for sealing optical windows in explosive initiators, said method comprising:

(a) disposing a solid body optical window in a passageway in a wall of an explosive initiator body to provide an annular space between said passageway wall and the outer periphery of said optical window body;

(b) filling said annular space with solder glass to form an assembly;

(c) heating said assembly to above the melting point of said solder glass for a time sufficient to melt said solder glass and fuse it to said optical window and said passageway wall so as to seal said optical window body in said passageway against leaks;

(d) thereafter cooling said assembly to ambient temperature sufficiently slowly so as to prevent cracking of said solder glass and window.

2. The improved method of claim 1 wherein said solder glass is a solid body abutting said periphery of said optical body and said passageway wall.

3. The improved method of claim 1 wherein said solder glass comprises a dry powder.

4. The improved method of claim 1 wherein said solder glass comprises an aqueous slurry.

5. The improved method of claim 1 wherein said passageway has a larger diameter portion and a contiguous smaller diameter portion defining a shelf therebetween, and wherein said optical glass body is first fitted inside said solder glass body and the resulting sub-assembly is slid through said larger diameter portion to abut said shelf.

6. The improved method of claim 5 wherein the diameter of said optical glass body is larger than that of said small diameter portion of said passageway.

7. The improved method of claim 1 wherein said heating is carried out at about 450° C. for about 1–1.5 hours and wherein said assembly is cooled to ambient temperature over a period of about 0.5–1 hr.

8. The improved method of claim 1 wherein said optical window body comprises one of fused silica glass and fused quartz.

9. The improved method of claim 8 wherein said initiator body comprises one of metal and ceramic.

10. The improved method of claim 9 wherein said initiator body comprises austenitic stainless steel.

* * * * *